United States Patent [19]

Kawai et al.

[11] Patent Number: 4,894,323

[45] Date of Patent: Jan. 16, 1990

[54] SILVER HALIDE PHOTOGRAPHIC MATERIAL COMPRISING A POLYOXYETHYLENIC COMPOUND AND A SENSITIZING DYE

[75] Inventors: Kiyoshi Kawai; Mikio Ihama, both of Kanagawa, Japan

[73] Assignee: Fuji Photo Film Co., Ltd., Ashigara, Japan

[21] Appl. No.: 53,673

[22] Filed: May 26, 1987

[30] Foreign Application Priority Data

May 27, 1986 [JP] Japan ..... 61-121781

[51] Int. Cl.[4] ..... G03C 1/19; G03C 1/28

[52] U.S. Cl. ..... 430/569; 430/588; 430/599; 430/602; 430/637

[58] Field of Search ..... 430/602, 588, 599, 569, 430/637

[56] References Cited

U.S. PATENT DOCUMENTS 3,915,713 10/1975 Shiba et al. ..... 430/602
4,266,003 5/1981 Ikeda et al. ..... 430/637
4,501,811 2/1985 Saikawa et al. ..... 430/588
4,551,424 11/1985 Ikeda et al. ..... 430/588
4,621,041 11/1986 Saikawa et al. ..... 430/588
4,623,615 11/1986 Yokoyama et al. ..... 430/637
4,693,965 9/1987 Ikama et al. ..... 430/588

*Primary Examiner*—Paul R. Michl
*Assistant Examiner*—Patrick Doody
*Attorney, Agent, or Firm*—Burns, Doane, Swecker & Mathis

[57] ABSTRACT

A novel silver halide photographic material is provided comprising a support having provided thereon at least one silver halide emulsion layer and containing at least one polyoxyethylenic compound in the emulsion layer or at least one other hydrophilic colloid layer, wherein silver halide grains contained in the emulsion layer are chemically sensitized in the presence of a water-soluble sensitizing dye having a solubility in 20° C. water of 0.2 g/100 ml $H_2O$ or more, or said water-soluble sensitizing dye is added to the silver halide emulsion after chemical sensitization and before coating. Such a water-soluble sensitizing dye is preferably selected from methine dyes and styryl dyes such as a cyanine dye, a merocyanine dye, a hemicyanine dye, a rhodacyanine dye, an oxonol dye, and a hemioxonol dye.

11 Claims, No Drawings

SILVER HALIDE PHOTOGRAPHIC MATERIAL COMPRISING A POLYOXYETHYLENIC COMPOUND AND A SENSITIZING DYE

FIELD OF THE INVENTION

The present invention relates to a silver halide photographic material. More particularly, the present invention relates to a high sensitivity photographic light-sensitive material having excellent development capabilities at high speeds and which is less subject to fog and color remaining.

BACKGROUND OF THE INVENTION

In general, when a silver halide photographic emulsion is coated on a support, a spectral sensitizing dye having the necessary absorption wavelength is added to the emulsion so that it is spectrally sensitized.

Examples of such sensitizing dyes which may be used for spectral sensitization include water-insoluble dyes and water-soluble dyes containing water-soluble groups. However, water-soluble dyes are disadvantageous in that they have a weak adsorption to grains and thus have a low color sensitivity compared to water-insoluble dyes. In contrast, water-soluble dyes are less subject to color remaining after processing than water-insoluble dyes. Thus, it has been very difficult to meet both the requirements for color sensitization and color remaining at the same time. Heretofore, color sensitivity has often had priority to color remaining. Thus, water-insoluble sensitizing dyes have generally been used.

It has been known that photographic sensitivity can be improved by incorporating a polyoxyethylenic compound in at least one layer in the photographic light-sensitive material. However, the sensitizing effect of the polyoxyethylenic compound has not been as high as expected in emulsion grain systems which include a large amount of a water-insoluble sensitizing dye, especially upon high speed development.

Nevertheless, no other compound has been found which surpasses the polyoxyethylenic compounds in sensitizing effect. Therefore, the best sensitizing method is to make the best use of the effect of the polyoxyethylenic compound.

Accordingly, studies have focused primarily on finding a suitable sensitizing dye and spectral sensitizing method which makes the best use of the sensitizing effect of polyoxyethylenic compounds.

Methods for adding a sensitizing dye to a photographic emulsion before chemical sensitization are known. For example, U.S. Pat. No. 4,425,426 discloses methods for adding a sensitizing dye to a photographic emulsion prior to or during chemical sensitization. Methods for adding spectral sensitizing dyes to photographic emulsions before the completion of the formation of silver halide grains are disclosed in U.S. Pat. Nos. 2,735,766, 3,628,960, 4,183,756 and 4,225,666.

Specifically, U.S. Pat. Nos. 4,183,756 and 4,225,666 disclose that the addition of a spectral sensitizing dye to a photographic emulsion after the formation of a stable nucleus of silver halide grains provides the advantages of improving the photographic sensitivity and intensifying the adsorption of a spectral sensitizing dye to silver halide grains.

In the above-described methods, the chemical sensitization is achieved in the presence of a spectral sensitizing dye. In such cases, however, the photographic sensitivity is often lowered or remains about the same due to the presence of the spectral sensitizing dye.

The inventors of the present invention have found that the combined use of a water-soluble sensitizing dye as a spectral sensitizing dye, silver halide grains which have been chemically sensitized in the presence of the spectral sensitizing dye, and a polyoxyethylenic compound, or the combined use of silver halide grains, a water-soluble sensitizing dye which is added to a chemically sensitized silver halide emulsion containing the silver halide grains prior to its coating and a polyoxyethylenic compound can provide for high sensitivity silver halide photographic materials having excellent development capabilities at high speeds and which are less subject to color remaining after processing. The inventors have also found that in such materials, the photographic sensitivity and development capabilities at high speeds are much the same as those emulsions to which the spectral sensitizing dye is added immediately before coating.

SUMMARY OF THE INVENTION

It is, therefore, an object of the present invention to provide high sensitivity photographic light-sensitive materials having excellent development capabilities at high speeds.

It is another object of the present invention to provide high sensitivity photographic light-sensitive materials which include a spectral sensitizing dye and which are less subject to remaining of spectral sensitizing dye after processing (i.e., color remaining).

These above objects of the present invention are accomplished with a silver halide photographic material which comprises a support having provided thereon at least one silver halide emulsion layer containing a silver halide emulsion and which contains at least one polyoxyethylenic compound in the emulsion layer or at least one other hydrophilic colloid layer, wherein silver halide grains contained in the silver halide emulsion are subjected to chemical sensitization with a water-soluble sensitizing dye having a solubility in 20° C. water of 0.2 g/100 ml $H_2O$ or more, or said water-soluble sensitizing dye is added to the silver halide emulsion after chemical sensitization and before coating.

These and other objects of the present invention will become readily apparent from the following detailed description of the invention and examples.

DETAILED DESCRIPTION OF THE INVENTION

The addition of the spectral sensitizing dye can be made during, at the beginning of, or prior to chemical ripening, or between completion of chemical ripening and before coating of the silver halide emulsion. Specifically, the spectral sensitizing dye can be added before, during, or after the addition of the silver salt solution, or by the beginning of or during chemical ripening in the process of forming the silver halide emulsion grains.

In addition, the spectral sensitizing dye can be added between completion of chemical ripening and before coating of the silver halide emulsion. In this case, the temperature of the emulsion may be the same as that at chemical ripening, or may be higher or lower than that at chemical ripening. Further, the addition of the sensitizing dye may be made during changing of the temperature. In particular, the temperature of the emulsion is preferably between 45° C. and 70° C.

In case of that silver halide grains are chemically sensitized in the presence of the water-soluble sensitizing dye, the sensitizing dye is preferably added during the formation of the silver halide grains, or after the formation of the silver halide grains and prior to chemical ripening, or during chemical ripening.

Alternatively, in case of that the water-soluble sensitizing dye is added to a chemically sensitized silver halide emulsion, the addition is preferably made prior to its coagulation by cooling.

As suitable sensitizing dyes there may be used any water-soluble sensitizing dye having a solubility of 0.2 g or more, preferably 0.5 g or more, in 100 ml of water at a temperature of 20° C. Examples of such sensitizing dyes include cyanine dyes, merocyanine dyes, hemicyanine dyes, rhodacyanine dyes, oxonol dyes, hemioxonol dyes, and other methine dyes or styryl dyes. Preferred among these dyes are cyanine dyes. In particular, cyanine dyes having the general formula (I) are useful.

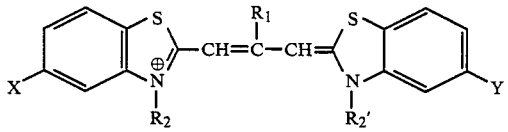

(I)

wherein $R_1$ represents an alkyl group; $R_2$ and $R_2'$ may be the same or different and each represents a carboxyalkyl group or a sulfoalkyl group; and X and Y may be the same or different and each represents a hydrogen atom, an alkoxyl group, a carboxyalkyl group, an acetylamino group, an alkyl group or a hydroxy group. The substituents represented by $R_1$, $R_2$, $R_2'$, X and Y preferably each contains 6 or less carbon atoms. Preferred examples of such cyanine dyes include those having the following general formulae:

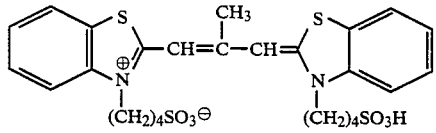

(I-1)

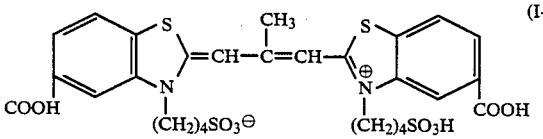

(I-2)

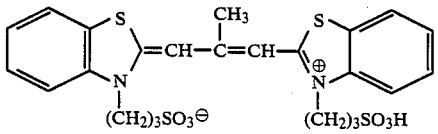

(I-3)

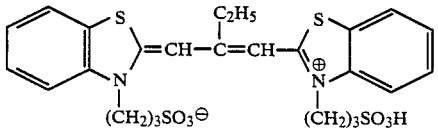

(I-4)

-continued

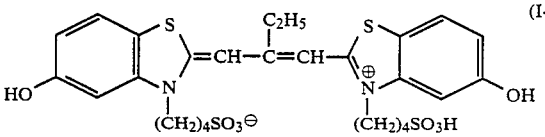

(I-5)

Particularly preferred among these cyanine dyes is that of the general formula (I-1).

The amount of the sensitizing dye to be added during the preparation of the silver halide emulsion (before or during the chemical sensitization, or between completion of the chemical sensitization and before coating) cannot be unequivocally determined by the type of additives or the amount of silver halides. However, the sensitizing dye can be used in amounts substantially equal to or slightly more than the amounts used in the above-described conventional methods. Specifically, the amount of the sensitizing dye to be added is preferably 0.01 to 10 mmol, more preferably 0.1 to 1 mmol, per mol of silver halide.

The silver halide emulsion to which the present invention is applied may include any one of silver bromide, silver iodobromide, silver iodochlorobromide, silver chlorobromide, and silver chloride as a silver halide. Preferred among these silver halides are silver bromide, silver iodobromide, and silver iodochlorobromide. Particularly preferred among these silver halides is silver iodobromide. The content of iodine is not specifically limited but is preferably 2 mol% or more and more preferably 5 mol% or more.

The shape of the silver halide grain is not specifically limited and may be cube, octahedron, rhombic dodecahedron, tetradecahedron, or tabular having an aspect ratio of 5 or more as described in *Research Disclosure*, Vol. 225 (pp. 20–58, January, 1983). Alternatively, the silver halide grain may have an epitaxial structure.

Furthermore, the silver halide grain may have a multilayer structure in which the inside and surface thereof are different in halogen composition.

The average grain size of silver halide grains to be used in the present invention preferably falls within the range of from 0.3 μm to 2.0 μm, more preferably 0.4 μm to 1.4 μm.

The terminology "average grain size" as used herein refers to the average size of all of the silver halide grains present in a particular silver halide emulsion layer. Furthermore, the average grain size refers to the diameter of the grains when the silver halide grains are spherical or similar to spherical grains, or indicates a calculated diameter value based on projected areas of the grains in the case of nonspherical type grains (e.g., such as cubic grains).

The preparation of the present silver halide emulsion can be accomplished by any suitable method such as those described in James, *The Theory of the Photographic Process* (4th Edition, published by Macmillan, 1976), and P. Grafkides, *Chimie et Photographique* (published by Paul Montel, 1957). For example, an acidic process, a neutral process, or an ammonia process may be used. The reaction of the soluble silver salt with the soluble halogen salt can be accomplished by a single jet mixing, a double jet mixing, or a combination thereof.

A method which comprises forming grains in excess silver ions (the so-called reverse mixing process) can also be used. One form of the double jet mixing process is the so-called controlled double jet process in which the pAg of the liquid phase in which the silver halide is formed is kept constant.

This process can provide a silver halide emulsion having grains of regular crystal shape and nearly uniform sizes (the so-called monodispersed silver halide emulsion). The term "monodispersed silver halide emulsion" as used herein means an emulsion having a grain size distribution represented by a variation coefficient (corresponding to the value of the standard deviation of the grain distribution curve of the silver halide grains as divided by the average grain size) of 0.20 or less, preferably 0.14 or less.

Alternatively, two or more silver halide emulsions which have been separately prepared can be mixed to obtain the desired emulsion.

A cadmium salt, a zinc salt, a lead salt, a thallium salt, an iridium salt or a complex salt thereof, a rhodium salt or a complex salt thereof, or an iron salt or a complex salt thereof may be present in the process for the formation of silver halide grains or in physical ripening. Alternatively, the formation of the silver halide grains may be effected in the presence of a silver halide solvent such as ammonia and a thioether compound.

In the preparation of the emulsion, after the formation of silver halide grains is complete (i.e., after the formation of precipitate or physical ripening), removal of the soluble salts (demineralization process) is generally effected. The demineralization process may be accomplished by the conventional noodle rinsing process which comprises gelation of gelatin or flocculation process using an inorganic salt comprising polyvalent anions such as sodium sulfate, anionic surface active agent, anionic polymer such as polystyrene sulfonic acid, or gelatin derivative such as aliphatic acylated gelatin, aromatic acylated gelatin, and aromatic carbamoylated gelatin.

The silver halide emulsion to be used in the present invention is subjected to chemical sensitization.

The chemical sensitization can be accomplished by a sulfur sensitization method using an active gelatin or a sulfur-containing compound which can react with silver such as thiosulfate, thiourea, a mercapto compound, and rhodanine, a reduction sensitization method using a reducing substance such as a stannous salt, amine, a hydrazine derivative, formamidinesulfinic acid or a silane compound, and a noble metal sensitization method using a noble metal compound such as a gold compound and complex salts of the group VIII metals of the Periodic Table, e.g., platinum, iridium, and palladium or a combination thereof.

In the present invention, the sulfur sensitization is preferably used singly or in combination with the gold sensitization method.

As suitable polyoxyethylenic compounds for the present invention there can be used compounds containing at least two oxyethylene groups, preferably 2 to 100 oxyethylene groups in the light of sensitizing effect. More particularly, compounds containing 10 to 100 oxyethylene groups are preferably used.

Specific preferred examples of such polyoxyethylenic compounds include surface active agents represented by the general formulae (II-1), (II-2) and (II-3) illustrated below:

$$R_1—A(CH_2CH_2O)_{n1}R_2 \quad \text{(II-1)}$$

(II-2)

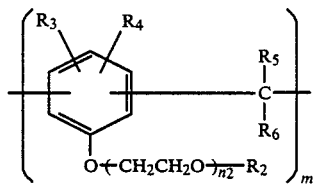

(II-3)

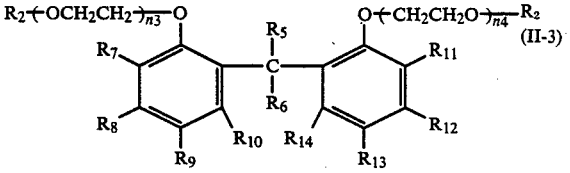

wherein $R_1$ represents a hydrogen atom, or a substituted or unsubstituted alkyl, alkenyl or aryl group having 1 to 30 carbon atoms; A represents an —O—group, an —S—group, a —COO—group, an $$—\overset{|}{N}—R_{15} \text{ group, a } —CO—\overset{|}{N}—R_{15}$$

group, or an $$—SO_2\overset{|}{N}—R_{15}$$

group in which $R_{15}$ represents a hydrogen atom, or a substituted or unsubstituted alkyl group; $R_2$ has the same meaning as $R_1$ or $R_1$-A-; $R_3$, $R_4$, $R_8$, $R_{10}$, $R_{12}$ and $R_{14}$ each represents a hydrogen atom, a substituted or unsubstituted alkyl, aryl or alkoxy group, a halogen atom, an acyl group, an amido group, a sulfonamido group, a carbamoyl group, or a sulfamoyl group; $R_7$, $R_9$, $R_{11}$ and $R_{13}$ each represents a substituted or unsubstituted alkyl, aryl or alkoxy group, a halogen atom, an acyl group, an amido group, a sulfonamido group, a carbamoyl group, or a sulfamoyl group; $R_5$ and $R_6$ each represents a hydrogen atom, or a substituted or unsubstituted alkyl, aryl or heterocyclic aromatic ring; $n_1$, $n_2$, $n_3$ and $n_4$ each represents an average polymerization degree of oxidized ethylene ranging from 2 to 100; and m represents an average polymerization degree of 5 to 50, with the proviso that $R_5$ and $R_6$, $R_7$ and $R_8$, $R_9$ and $R_{10}$, $R_{11}$ and $R_{12}$, and $R_{13}$ and $R_{14}$ each may be connected to each other to form a substituted or unsubstituted ring.

In the general formulae (II-1), (II-2) and (II-3), $R_1$ is preferably a hydrogen atom, or an alkyl, alkenyl or alkylaryl group having 4 to 24 carbon atoms, particularly preferably a hydrogen atom, a butyl group, a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, an m-pentadecaphenyl group, a t-octylphenyl group, a 2,4-dinonylphenyl group, or an octylnaphthyl group.

$R_3$, $R_4$, $R_7$, $R_8$, $R_9$, $R_{10}$, $R_{11}$, $R_{12}$, $R_{13}$ and $R_{14}$ each is preferably a substituted or unsubstituted alkyl group having 1 to 20 carbon atoms such as methyl, ethyl, i-propyl, t-butyl, t-amyl, t-hexyl, t-octyl, nonyl, decyl, dodecyl, trichloromethyl, tirbromomethyl, 1-phenylethyl, and 2-phenyl-2-propyl, a substituted or unsubstituted aryl group such as a phenyl group and a p-chlorophenyl group, a substituted or unsubstituted alkoxy group represented by $-OR_{16}$ in which $R_{16}$ hereinafter represents a substituted or unsubstituted alkyl or aryl group having 1 to 20 carbon atoms, a halogen atom such as a chlorine atom and a bromine atom, an acyl group represented by $-COR_{16}$, an amido group represented by $-NR_{17}COR$ in which $R_{17}$ hereinafter represents a hydrogen atom or an alkyl group having 1 to 20 carbon atoms, a sulfonamide group represented by $-NR_{17}SO_2R_{16}$, a carbamoyl group represented by

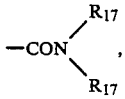

or a sulfamoyl group represented by

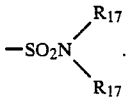

Alternately, $R_3$, $R_4$, $R_8$, $R_{10}$, $R_{12}$ and $R_{14}$ each may be a hydrogen atom. $R_7$, $R_9$, $R_{11}$ and $R_{13}$ each is preferably an alkyl group or a halogen atom, particularly a tertiary alkyl group such as a bulky t-butyl group, a t-amyl group and a t-octyl group. $R_8$, $R_{10}$, $R_{12}$ and $R_{14}$ each is particularly preferably a hydrogen atom. In other words, a compound of the general formula (II-3) synthesized from 2,4-di-substituted phenol is particularly preferably used.

$R_5$ and $R_6$ each is preferably a hydrogen atom, a substituted or unsubstituted alkyl group such as a methyl group, an ethyl group, an n-propyl group, an i-propyl group, an n-heptyl group, a 1-ethylamyl group, an n-undecyl group, a trichloromethyl group, and a tribromomethyl group, or a substituted or unsubstituted aryl group such as an α-furyl group, a phenyl group, a naphthyl group, a p-chlorophenyl group, a p-methoxyphenyl group, and an m-nitrophenyl group.

$R_5$ and $R_6$, $R_7$ and $R_8$, $R_9$ and $R_{10}$, $R_{11}$ and $R_{12}$, and $R_{13}$ and $R_{14}$ each may be connected to each other to form a substituted or unsubstituted ring such as a cyclohexyl group. $R_5$ and $R_6$ each is particularly preferably a hydrogen atom, an alkyl group having 1 to 8 carbon atoms, a phenyl group, or a furyl group. In the above general formulae, $n_1$, $n_2$, $n_3$ and $n_4$ each is particularly preferably an integer of 5 to 30. Particularly, $n_3$ and $n_4$ may be the same or different.

Specific examples of the present polyoxyethylenic compounds will be shown below, but the present invention should not be construed as being limited thereto.

$C_{11}H_{23}COO(CH_2CH_2O)_8H$ (II-1)

$C_{15}H_{31}COO(CH_2CH_2O)_{15}H$ (II-2)

$C_{17}H_{33}COO(CH_2CH_2O)_{15}CH_3$ (II-3)

$C_{18}H_{35}O(CH_2CH_2O)_{25}H$ (II-4)

$C_{12}H_{25}O(CH_2CH_2O)_{10}H$ (II-5)

$C_{16}H_{33}O(CH_2CH_2O)_{23}H$ (II-6)

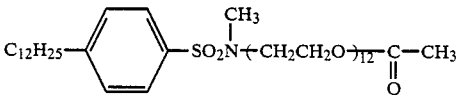

(II-7)

-continued $C_{22}H_{45}O(CH_2CH_2O)_{25}H$ (II-8)

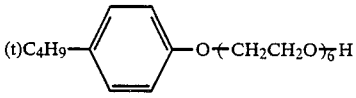

(II-9)

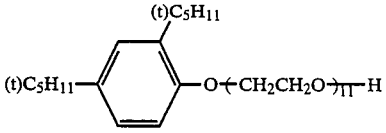

(II-10)

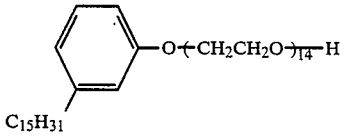

(II-11)

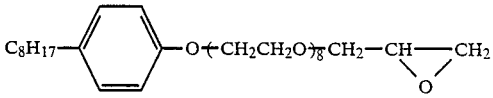

(II-12)

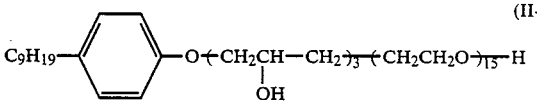

(II-13)

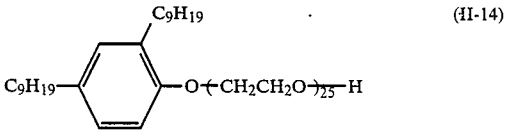

(II-14)

(II-15)

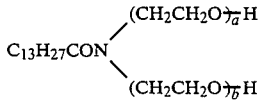

a + b = 15

(II-16)

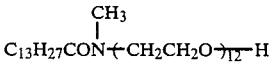

(II-17)

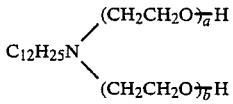

a + b = 20

(II-18)

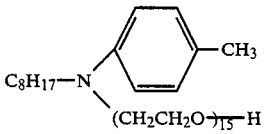

$C_{12}H_{25}S(CH_2CH_2O)_{16}H$ (II-19)

$C_{12}H_{25}O(CH(CH_3)CH_2O)_3(CH_2CH_2O)_{15}H$ (II-20)

-continued
(II-21)
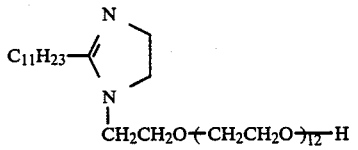
(II-22)
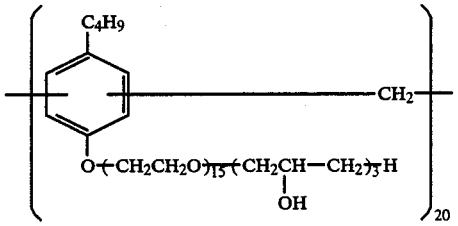
(II-23)
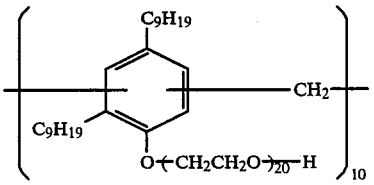
(II-24)
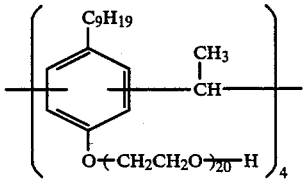
(II-25)
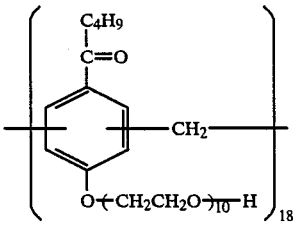
(II-26)
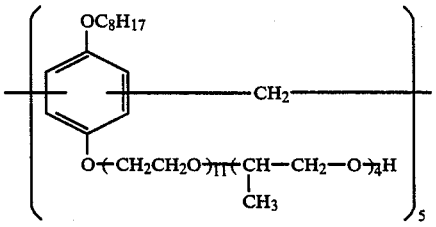
(II-27)
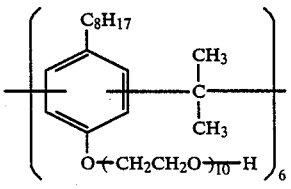
-continued
(II-28)
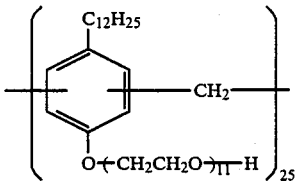
(II-29)
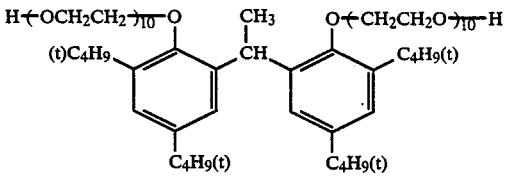
(II-30)
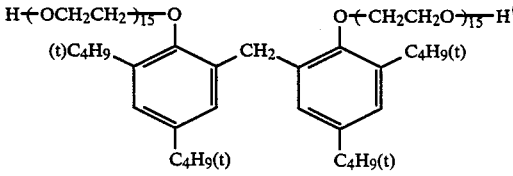
(II-31)
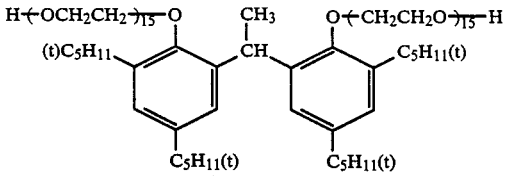
(II-32)
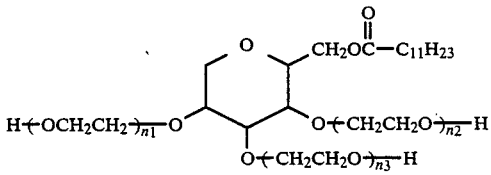
$n_1 + n_2 + n_3 = 25$
(II-33)
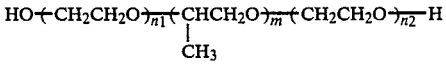
$n_1 + n_2 = 30, m = 10$
(II-34)
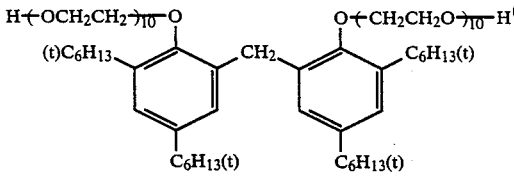
(II-35)
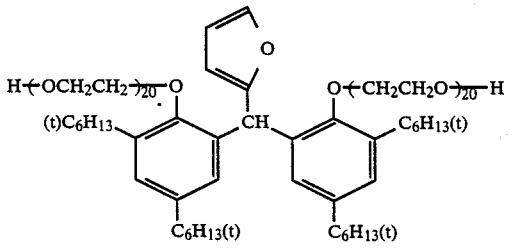
(II-36)
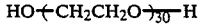

-continued

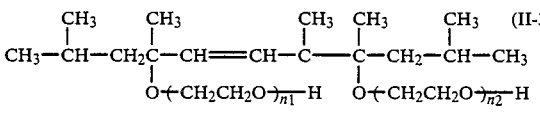

(II-37)

$n_1 + n_2 = 16$

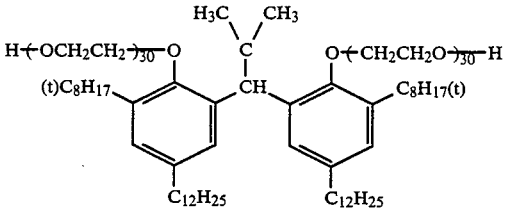

(II-38)

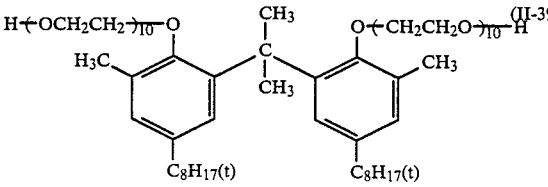

(II-39)

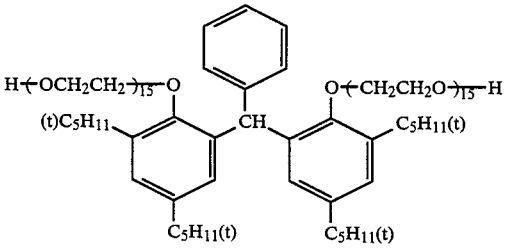

(II-40)

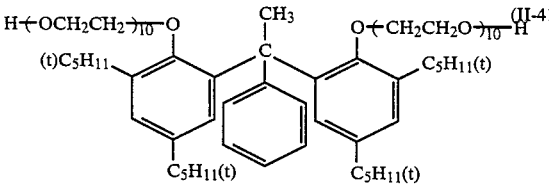

(II-41)

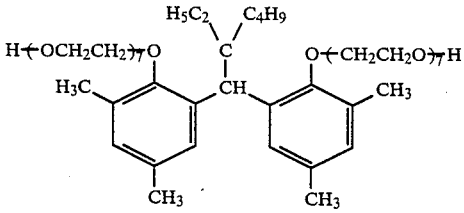

(II-42)

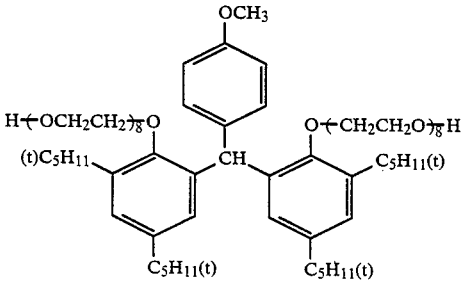

(II-43)

-continued

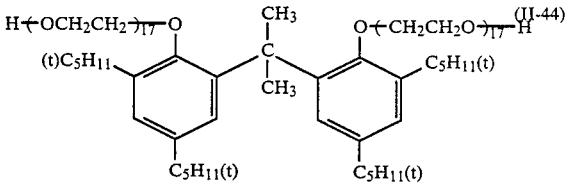

(II-44)

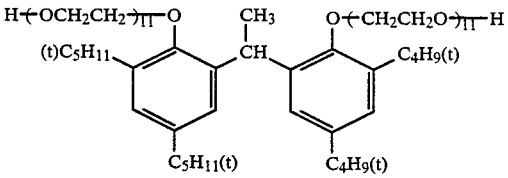

(II-45)

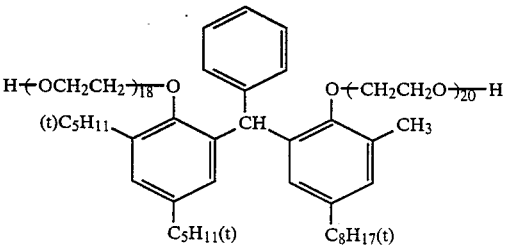

(II-46)

The amount of the present polyoxyethylenic compound to be used depends on the type and form of the photographic light-sensitive material used and the coating process. However, it is preferably in the range of $1\times10^{-5}$ to 1 mol, more preferably $5\times10^{-5}$ to 0.1 mol, per mol of total silver halide.

The present polyoxyethylenic compound is preferably incorporated in the light-sensitive emulsion layer of the photographic light-sensitive material. However, it may be incorporated in other light-insensitive layers.

The application of the polyoxyethylenic compound to the photographic light-sensitive material may be accomplished by adding the polyoxyethylenic compound to the coating solution for the formation of the layer directly or in the form of a solution in water, an organic solvent such as methanol, ethanol, and acetone, or a mixture solvent of water and such an organic solvent, coating the admixture on the support, and drying the coat or by spraying or coating the surface of the support with the solution or dipping in the coating solution and drying the coat.

The incorporation of the polyoxyethylenic compound in the emulsion layer may be effected during or after preparation of the emulsion (e.g., during chemical ripening). In particular, the polyoxyethylenic compound is preferably added to the emulsion after preparation and immediately before coating.

Alternatively, the polyoxyethylenic compounds may be incorporated in layers of two or more.

In order to prevent fogging during preparation, storage or processing of the light-sensitive material or to stabilize the photographic properties, the photographic emulsion to be used in the present invention may contain various compounds known as antifoggants or stabilizers. Examples of such compounds include azoles such as benzothiazolium salts, nitroimidazole, nitrobenzimidazole, chlorobenzimidazole, bromobenzimidazole, nitroindazole, benzotriazole, and aminotriazole; mercapto compounds such as mercaptothiazole, mercaptobenzothiazole, mercaptobenzimidazole, mercaptothiadiazole, mercaptotetrazole (particularly 1-phenyl-5-mercaptotetrazole), mercaptopyrimidine, and mercaptotriazine; thioketo compounds such as oxazolinethione; azaindenes such as triazaindene, tetraazaindene (particularly 4-hydroxy-substituted(1,3,3a,7)tetraazaindene), and pentaazaindene; benzenethiosulfonic acid; benzenesulfinic acid; and benzenesulfonic acid amide.

The amount of the present silver halide emulsion to be coated is not specifically limited. It is preferably in the range of 0.5 to 10 g/m$^2$, particularly preferably 1 to 5 g/m$^2$, as calculated in terms of amount of silver per one emulsion layer.

The thickness of the present silver halide emulsion layer is not specifically limited. It is preferably in the range of 0.5 to 15 μm, particularly preferably 1 to 10 μm.

The silver halide photographic material of the present invention may contain hydrophilic colloid layers such as other silver halide emulsion layers and light-insensitive layers (e.g., a surface protective layer and an intermediate layer) in addition to the above-described emulsion layer comprising silver halide.

The structure of the silver halide emulsion layer and other hydrophilic colloid layers will be further described below.

As suitable binders or protective colloids for the emulsion layer or intermediate layer in the light-sensitive material, gelatin may be advantageously used. However, other hydrophilic colloids may also be used.

For example, proteins such as gelatin derivatives, graft polymers of gelatin with other high molecular compounds, albumin, and casein; sugar derivatives such as cellulose derivatives (e.g., hydroxyethyl cellulose, carboxymethyl cellulose, and cellulose sulfuric esters), soda alginate, and starch derivatives; or monopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole may be used.

The photographic light-sensitive material of the present invention may include inorganic or organic hardeners in the photographic emulsion layer or other hydrophilic colloid layers. Examples of such hardeners include chromium salts such as chrome alum, and chromium acetate, aldehydes such as formaldehyde, glyoxal, and glutaraldehyde, N-methylol compounds such as dimethylolurea, and methyloldimethylhydantoin, dioxane derivatives such as 2,3-dihydroxydioxane, active vinyl compounds such as 1,3,5-triacryloylhexahydro-s-triazine, and 1,3-vinylsulfonyl-2-propanol, active halogen compounds such as 2,4-dichloro-6-hydroxy-s-triazine, and mucohalogenic acids such as mucochloric acid, and mucophenoxychloric acid. These compounds may be used singly or in combination.

The photographic emulsion layer or other hydrophilic colloid layers in the light-sensitive material prepared in accordance with the present invention may include various surface active agents for the purpose of facilitating coating, preventing electrostatic charging, assisting emulsion dispersion, preventing adhesion, and improving sliding properties, or similar purposes.

Examples of such surface active agents include nonionic surface active agents such as saponin (steroid series), glycidol derivatives such as polyglyceride alkenylsuccinate, and alkylphenol polyglyceride, aliphatic esters or olyvalent alcohols, and alkyl esters of sugars; anionic surface active agents containing acidic groups such as carboxy groups, sulfo groups, phosphonic groups, sulfuric ester groups, and phosphoric ester groups including compounds such as alkylcarboxylate, alkylsulfonate, alkylbenzenesulfonate, alkylnaphthalenesulfonate, alkylsulfuric ester, alkylphosphoric ester, N-acyl-N-alkyltaurine, sulfosuccinic ester, sulfoalkylpolyoxyethylenealkylphenylether, and polyoxyethylenealkylphosphoric ester; amphoteric surface active agents such as amino acids, aminoalkylsulfonic acids, aminoalkyl sulfuric or phosphoric esters, alkylbetaines, and amine oxides; and cationic surface active agents such as alkylamines, aliphatic or aromatic quaternary ammonium salts, heterocyclic quaternary ammonium salts such as pyridinium, and imidazolium, and phosphonium or sulfonium salts containing aliphatic groups or heterocyclic rings.

In particular, fluorine-containing surface active agents such as those described in Japanese Patent Application (OPI) No. 80849/85 (the term "OPI" as used herein refers to a "published unexamined Japanese patent application"), are useful for the adjustment of electrostatic charging.

The photographic emulsion to be used in the present invention may be spectrally sensitized with a methine dye or other dyes before being coated on a suitable support besides before the beginning of chemical ripening, during its use, or between after the completion of chemical ripening and before coating. Examples of such dyes include cyanine dyes, merocyanine dyes, complex cyanine dyes, complex merocyanine dyes, holopolar cyanine dyes, hemicyanine dyes, styryl dyes, and hemioxonol dyes. Particularly useful among the above dyes are cyanine dyes, merocyanine dyes and complex merocyanine dyes. Any suitable nucleus which is commonly used for a cyanine dye can be applied to the dyes as a basic heterocyclic nucleus. Examples of such nuclei include the pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; nuclei to which alicyclic hydrocarbon rings are fused; and nuclei to which aromatic hydrocarbon rings are fused such as the indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, and quinoline nucleus. The above nuclei may be connected to carbon atoms.

5- or 6-membered heterocyclic nuclei such as the pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus can be applied to the merocyanine dye or complex merocyanine dye as nuclei containing a ketomethylene structure.

The present emulsion may contain a dye which itself does not have a spectral sensitization effect or a substance which does not substantially absorb visible light but exhibits a supersensitization effect together with the above-described sensitizing dyes. Examples of such dyes or substances include aminostyryl compounds such as those described in U.S. Pat. Nos. 2,933,390 and 3,635,721, aromatic organic formaldehyde condensates such as those described in U.S. Pat. No. 3,743,510, cadmium salts, and azaindene compounds. Combinations such as those described in U.S. Pat. Nos. 3,615,613, 3,615,641, 3,617,295, and 3,635,721 are particularly useful.

The photographic emulsion layer in the present photographic light-sensitive material may include thioether compounds, thiomorpholines, quaternary ammonium salt compounds, urethane derivatives, urea derivatives, imidazole derivatives, 3-pyrazolidones or the like for the purpose of improving sensitivity and contrast or accelerating development. For example, compounds such as those described in U.S. Pat. Nos. 2,400,532, 2,423,549, 2,716,062, 3,617,280, 3,772,021 and 3,808,003, and British Pat. No. 1,488,991 may be used.

The photographic emulsion layer or other hydrophilic colloid layers in the present photographic light-sensitive material may include a dispersion of a water-insoluble or sparingly water-soluble synthetic polymer for the purpose of improving the dimensional stability or similar purposes. For example, polymers which include as monomer components at least one of alkyl (meth)acrylate, alkoxyalkyl (meth)acrylate, glycidyl (meth)acrylate, (meth)acrylamide, vinyl ester (e.g., vinyl acetate), acrylonitrile, olefin, and styrene, or a combination of these compounds with acrylic acid, methacrylic acid, $\alpha,\beta$-unsaturated dicarboxylic acid, hydroxyalkyl (meth)acrylate, sulfoalkyl (meth)acrylate, styrenesulfonic acid or the like may be used.

In the present invention, a support, preferably a transparent and/or flexible support, may be added to one side or both sides of the silver halide photographic emulsion which is used in the present invention. Specific examples of the supports which may be used in the present invention include a cellulose nitrate film, a cellulose acetate film, a polyvinyl acetal film, a polystyrene film, a polyethylene terephthalate film, or other polyester films, and glass, paper, metal, or wood, etc.

The photographic light-sensitive material of the present invention may contain a dye-forming coupler, i.e., a compound which can form a color upon oxidation coupling with an aromatic primary amine developing agent such as a phenylenediamine derivative and an aminophenol derivative in the color development process. As such a coupler there may be preferably used a nondiffusible coupler containing a hydrophobic group called a ballast group in its molecule, or a polymerized polymer. Such a coupler may be 2- or 4-equivalent to silver ion. Alternatively, the photographic light-sensitive material of the present invention may contain a colored coupler having a color correction effect or a coupler which releases a development inhibitor upon development (i.e., a DIR coupler). Furthermore, the photographic light-sensitive material of the present invention may contain a colorless DIR coupling compound which produces a non-color material and releases a development inhibitor upon coupling reaction.

Examples of suitable magenta couplers include 5-pyrazolone couplers, pyrazolobenzimidazole couplers, cyanoacetylcoumarone couplers, and open chain acylacetonitrile couplers. Examples of suitable yellow couplers include acylacetamide couplers such as benzoylacetanilide and pivaloylacetanilide. Examples of suitable cyan couplers include naphthol couplers and phenol couplers.

The above structure or other structures of the photographic light-sensitive material of the present invention are not specifically limited. In this respect, reference can be made to the description in *Research Disclosure*, Nos. 17643 (Vol. 176, December, 1978) and 18716 (Vol. 187, November, 1979). The places in the above *Research Disclosure* where various additives are described are shown in the following table:

| Type of Additive | RD No. 17643 | RD No. 18716 |
|---|---|---|
| 1. Chemical Sensitizer | Page 23 | Page 648, right column |
| 2. Sensitivity Improver | | Page 648, right column |
| 3. Spectral Sensitizer, Supersensitizer | Pages 23–24 | Page 648, right column |
| 4. Antifoggant and Stabilizer | Pages 24–25 | Page 649, right column |
| 5. Light Absorbent, Filter Dye, and Ultraviolet Absorbent | Pages 25–26 | Page 649, right column to page 650, left column |
| 6. Stain Inhibitor | Page 25, right column | Page 650, left column to right column |
| 7. Hardener | Page 26 | Page 651, left column |
| 8. Binder | Page 26 | Page 651, left column |
| 9. Plasticizer, Lubricant | Page 27 | Page 650, right column |
| 10. Coating Aid, Surface | Pages 26–27 right column Active Agent | Page 650, |
| 11. Antistatic Agent | Page 27 | Page 650, right column |
| 12. Color Coupler | Page 25 | Page 649, right column |

The silver halide photographic material of the present invention may be used in a variety of applications such as X-ray light-sensitive material, lith light-sensitive material, black-and-white light-sensitive material for photography, color negative light-sensitive material for photography, color reversal light-sensitive material, and color photographic paper. Preferably the silver halide photographic material of the present invention is used in a negative light-sensitive material for photography.

The processing of the light-sensitive material of the present invention can be accomplished by any suitable known method. As a suitable processing solution there can be used any known processing solution. The processing temperature is generally selected between 18° C. and 50° C. However, it may be below 18° C. or above 50° C.

The effects of the present invention are particularly remarkable in the black-and-white light-sensitive material. As suitable black-and-white developing solutions there can be used known developing agents such as dihydroxybenzenes such as hydroquinone, 3-pyrazolidones such as 1-phenyl-3-pyrazolidone, and aminophenols such as N-methyl-p-aminophenol, either singly or in combination.

The present invention will be further illustrated by the following examples. However, the present invention should not be construed as being limited thereto.

EXAMPLE 1

(1) Preparation of Emulsions

Solutions B and C having the following compositions were added to Solution A having the following composition in a reaction vessel at the same time for 30 minutes at 65° C.

| Solution A | | Solution B | | Solution C | |
|---|---|---|---|---|---|
| Gelatin | 20 g | Silver nitrate | 120 g | KBr | 65 g |
| KBr | 25 g | $H_2O$ | 580 ml | $H_2O$ | 580 ml |
| KI | 7 g | | | | |

-continued

| Solution A | | Solution B | Solution C |
|---|---|---|---|
| $NH_3$ | 12 g | | |
| $H_2O$ | 850 ml | | |

After being demineralized by the flocculation process well known in the photographic art, the emulsion thus obtained was subjected to chemical sensitization as described hereinafter. In the chemical sensitization, the pH value of the emulsion was 6.50, the pAg value of the emulsion was 8.60, and the temperature of the emulsion was 50° C.

Emulsion A (comparative example):

The emulsion thus obtained was subjected to chemical sensitization with sodium thiosulfate and chloroauric acid to obtain Emulsion A.

Emulsion B (present invention):

Dye I (water-soluble):

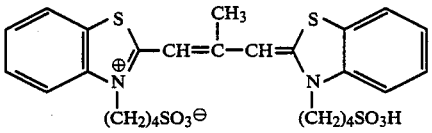

Solubility: 0.5 g/100 ml $H_2O$ or more

An aqueous solution of Dye I was added to the emulsion thus obtained in an amount of $3.5\times10^{-4}$ mol/mol $AgNO_3$. The admixture was then subjected to ripening for 30 minutes. The emulsion was subjected to chemical sensitization with sodium thiosulfate and chloroauric acid to obtain Emulsion B.

Emulsion C (comparative example):

Dye II (water-insoluble):

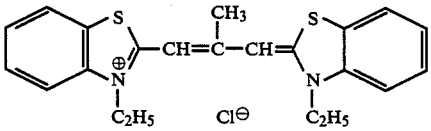

Solubility: 0.1 g/100 ml $H_2O$ or less

A methanol solution of Dye II was added to the emulsion thus obtained in an amount of $3.5\times10^{-4}$ mol/mol $AgNO_3$. The admixture was then subjected to ripening for 30 minutes. The emulsion was subjected to chemical sensitization with sodium thiosulfate and chloroauric acid.

(2) Preparation of Samples

Sensitizing dyes and a polyoxyethylenic compound (II-4) were added to each of the emulsions thus-obtained as shown in Table 1. The emulsions thus prepared were immediately coated on a cellulose acetate film. A coating solution comprising sodium dodecylbenzenesulfonate as a coating aid and a surface protective coating solution (10% gelatin aqueous solution containing 2,4-dichloro-6-hydroxy-s-triazine sodium salt, sodium dodecylbenzenesulfonate, and finely divided polymethyl methacrylate) were coated on the support at the same time to prepare Sample Nos. 1 to 8 as shown in Table 1. The coated amount was 4 g/m² as calculated in terms of amount of silver.

TABLE 1

| Sample No. | Emulsion Used | Compounds Added Immediately Before Coating: Polyoxyethylene (II-4) (mg/m²) | Sensitiving Dye: Kind | Sensitiving Dye: Amount (mol/mol $AgNO_3$) | Remarks |
|---|---|---|---|---|---|
| 1 | A | 10 | Dye I | $3.5\times10^{-4}$ | Comparison |
| 2 | A | " | Dye II | " | " |
| 3 | B | " | — | — | Invention |
| 4 | C | " | — | — | Comparison |
| 5 | A | — | Dye I | $3.5\times10^{-4}$ | " |
| 6 | A | — | Dye II | " | " |
| 7 | B | — | — | — | " |
| 8 | C | — | — | — | " |

The samples were exposed to light through an optical wedge, and then subjected to 4-minute development, 7-minute development, and 12-minute development at a temperature of 20° C. with a developing solution having the following composition:

| Developing Solution: | |
|---|---|
| p-Methylaminophenol Sulfate | 2 g |
| Sodium Sulfite | 100 g |
| Hydroquinone | 5 g |
| Borax (decahydrate) | 2 g |
| Water to make | 1 liter |

The developed samples were then subjected to fixation for 10 minutes with a fixing solution having the composition defined below. The fixed samples were washed with water for 10 minutes and then dried. The samples were measured for photographic sensitivity in terms of the reciprocal of the exposure required to provide a density of 0.1 higher than fog density. The values used are relative to that of Sample No. 2 which has been subjected to 4-minute development as 100. The evaluation on the sensitivity and remaining color are shown in Table 2.

The evaluation of remaining color was conducted by eyes on the unexposed portion of the samples which had been subjected to 7-minute development. The evaluation was made by the following symbols:

o: No remaining color observed

Δ: Slight remaining color observed x: Remaining color clearly observed xx: Too much remaining colors to be accepted

| Fixing Solution: | |
|---|---|
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |
| pH to make | 4.2 |

TABLE 2

| Sample No. | Development Time (min) | Relative Sensitivty | Remaining Color |
|---|---|---|---|
| | 4 | 110 | — |
| 1 | 7 | 200 | o |

TABLE 2-continued

| Sample No. | Development Time (min) | Relative Sensitivty | Remaining Color |
|---|---|---|---|
| | 12 | 270 | — |
| | 4 | 100 | — |
| 2 | 7 | 230 | x |
| | 12 | 320 | — |
| | 4 | 130 | — |
| 3 (Invention) | 7 | 300 | o |
| | 12 | 510 | — |
| | 4 | 90 | — |
| 4 | 7 | 200 | xx |
| | 12 | 280 | — |
| | 4 | 55 | — |
| 5 | 7 | 110 | o |
| | 12 | 150 | — |
| | 4 | 60 | — |
| 6 | 7 | 120 | x |
| | 12 | 160 | — |
| | 4 | 60 | — |
| 7 | 7 | 110 | o |
| | 12 | 150 | — |
| | 4 | 60 | — |
| 8 | 7 | 120 | xx |
| | 12 | 150 | — |

Table 2 shows that the combination of the emulsion which has been chemically sensitized in accordance with the present invention, and the polyoxyethylenic compound, can provide a light-sensitive material having development capabilities at high speeds and which is less subject to color remaining.

EXAMPLE 2

(1) Preparation of Emulsions

The same emulsion as in Example 1, which was demineralized by the flocculation process well known in the photographic art was subjected to chemical sensitization as described hereinafter.

Emulsion D (present invention):

The emulsion was subjected to the optimum chemical sensitization with sodium thiosulfate and chloroauric acid at 50° C. Then, an aqueous solution of Dye I was added to the chemically sensitized emulsion in an amount of $3.5\times10^{-4}$ mol/mol $AgNO_3$ at 50° C. After the emulsion was maintained for 15 minutes at the same temperature, it was cooled rapidly to obtain Emulsion D.

Emulsion E (comparative example):

The emulsion was subjected to the same chemical sensitization as in Emulsion D. Then, a methanol solution of Dye II was added to the chemically sensitized emulsion in an amount of $3.5\times10^{-4}$ mol/mol $AgNO_3$ at 50° C. After the emulsion was maintained for 15 minutes at the same temperature, it was cooled rapidly to obtain Emulsion E.

(2) Preparation of Samples

Sensitizing dyes and a polyoxyethylenic compound (II-4) were added to each of the emulsions thus-obtained as shown in Table 3. The emulsions thus-prepared were immediately coated on a cellulose acetate film. A coating solution comprising sodium dodecylbenzenesulfonate as a coating aid and a surface protective coating solution (10% gelatin aqueous solution containing 1,2-(vinylsulfonyl acetamido)ethane, sodium dodecylbenzenesulfonate, and finely divided polymethyl methacrylate) were coated on the support at the same time to prepare Sample Nos. 9 to 16 as shown in Table 3. The coated amount was 6 g/m² as calculated in terms of amount of silver. The coated amount of gelatin and 1,2-(vinylsulfonyl acetamido)ethane were 11 g/m² and $1.1\times10^{-4}$ mol/m², respectively.

TABLE 3

| Sample No. | Emulsion Used | Compounds Added Immediately Before Coating: Polyoxyethylene (II-4) (mg/m²) | Sensitizing Dye: Kind | Sensitizing Dye: Amount (mol/mol $AgNO_3$) | Remarks |
|---|---|---|---|---|---|
| 9 | A | 10 | Dye I | $3.5\times10^{-4}$ | Comparison |
| 10 | A | " | Dye II | " | " |
| 11 | D | " | — | — | Invention |
| 12 | E | " | — | — | Comparison |
| 13 | A | — | Dye I | $3.5\times10^{-4}$ | " |
| 14 | A | — | Dye II | " | " |
| 15 | D | — | — | — | " |
| 16 | E | — | — | — | " |

The samples were processed and evaluated analogous to Example 1. The results are shown in Table 4 below.

TABLE 4

| Sample No. | Development Time (min) | Relative Sensitivity | Remaining Color |
|---|---|---|---|
| | 4 | 110 | — |
| 9 | 7 | 200 | o |
| | 12 | 270 | — |
| | 4 | 100 | — |
| 10 | 7 | 230 | x |
| | 12 | 320 | — |
| | 4 | 117 | — |
| 11 (Invention) | 7 | 245 | o |
| | 12 | 395 | — |
| | 4 | 93 | — |
| 12 | 7 | 209 | xx-x |
| | 12 | 302 | — |
| | 4 | 55 | — |
| 13 | 7 | 110 | o |
| | 12 | 150 | — |
| | 4 | 60 | — |
| 14 | 7 | 120 | x |
| | 12 | 160 | — |
| | 4 | 58 | — |
| 15 | 7 | 108 | o |
| | 12 | 147 | — |
| | 4 | 60 | — |
| 16 | 7 | 120 | xx-x |
| | 12 | 150 | — |

Table 4 shows that the combination of the emulsion to which the water-soluble sensitizing dye was added after chemical sensitization and before coating in accordance with the present invention, and the polyoxyethylenic compound, can also provide a light-sensitive material having development capabilities at high speeds and which is less subject to color remaining.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having provided thereon at least one silver halide emulsion layer containing a silver halide emulsion and which contains at least one polyoxyethylenic compound in said emsulion layer or at least one other hydrophilic colloid layer, wherein silver halide grains contained in the silver halide emulsion are chemically sensitized in the presence of a water-soluble spectral sensitizing dye having a solubility in 20° C. water of 0.2 g/100 ml $H_2O$ or more, or said water-soluble sensitizing dye is added to the silver halide emulsion after chemical sensitization and before coating, wherein said sensitizing dye is a cyanine dye having the formula:

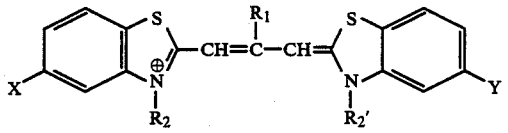

(I)

where $R_1$ represents an alkyl group; $R_2$ and $R_2'$ are the same or different and represent a carboxyalkyl group or a sulfoalkyl group; and X and Y are the same or different and represent a hydrogen atom, and alkoxyl group, a carboxyalkyl group, an acetylamino group, an alkyl group or a hydroxy group, and wherein the polyoxyethylenic compound is selected from surface active agents represented by the general formulae (II-1), (II-2) and (II-3):

$$R_1—A(CH_2CH_2O)_{n1}R_2 \quad \text{(II-1)}$$

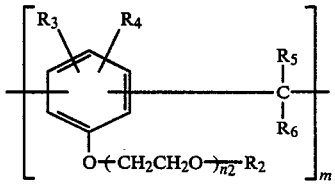

(II-2)

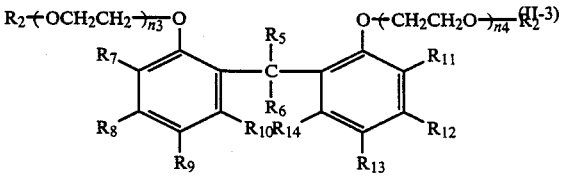

(II-3)

wherein $R_1$ represents a hydrogen atom, or a substituted or unsubstituted alkyl, alkenyl or aryl group having 1 to 30 carbon atoms, A represents an —O— group, an —S— group, a —COO— group, an —N—$R_{15}$ group, a —CO—N—$R_{15}$ group, or an —$SO_2$N—$R_{15}$ group in which $R_{15}$ represents a hydrogen atom, or a substituted or unsubstituted alkyl group, $R_2$ has the same meaning as $R_1$ or $R_1$-A, $R_3$, $R_4$, $R_8$, $R_{10}$, $R_{12}$ and $R_{14}$ each presents a hydrogen atom, a substituted or unsubstituted alkyl, aryl or alkoxy group, a halogen atom, an acyl group, an amido group, a sulfonamido group, a carbamoyl group, or a sulfamoyl group, $R_7$, $R_9$, $R_{11}$ and $R_{13}$ each represent a substituted or unsubstituted alkyl, aryl or alkoxy group, a halogen atom, an acryl group, an amido group, a sulfonamido group, a carbamoyl group, or a sulfamoyl group, $R_5$ and $R_6$ each represent a hydrogen atom, or a substituted or unsubstituted alkyl, aryl or heterocyclic aromatic ring, $n_1$, $n_2$, $n_3$ and $n_4$ each represent an average polymerization degree of oxidized ethylene ranging from 2 to 100, and m represents an average polymerization degree of 5 to 50, with the proviso that $R_5$ and $R_6$, $R_7$ and $R_8$, $R_9$ and $R_{10}$, $R_{11}$ and $R_{12}$, and $R_{13}$ and $R_{14}$ each may be connected to each other to form a substituted or unsubstituted ring.

2. A silver halide photographic material as claimed in claim 1, wherein the silver halide grains have been sensitized in the presence of a water-soluble sensitizing dye having a solubility in 20° C. water of 0.5 g/100 ml $H_2O$ or more.

3. A silver halide photographic material as claimed in claim 1, wherein the sensitizing dye is present in an amount of 0.01 to 10 mmol per mol of silver halide.

4. A silver halide photographic material as claimed in claim 3, wherein the sensitizing dye is present in an amount of 0.1 to 1 mmol per mol of silver halide.

5. A silver halide photographic material as claimed in claim 1, wherein the silver halide emulsion layer contains at least one of silver bromide, silver iodobromide, silver iodochlorobromide, silver chlorobromide and silver chloride.

6. A silver halide photographic material as claimed in claim 5, wherein the silver halide emulsion layer contains silver iodobromide.

7. A silver halide photographic material as claimed in claim 1, wherein the polyoxyethylenic compound contains at least two oxyethylene groups.

8. A silver halide photographic material as claimed in claim 7, wherein the polyoxyethylenic compound contains 10 to 100 oxyethylene groups.

9. A silver halide photographic material as claimed in claim 1, wherein the polyoxyethylenic compound is present in an amount of $1\times10^{-5}$ mol to 1 mol per mol of total silver halide.

10. A silver halide photographic material as claimed in claim 9, wherein the polyoxyethylenic compound is present in an amount of $5\times10^{-5}$ mol to 0.1 mol per mol of total silver halide.

11. A silver halide photographic material as claimed in claim 1, wherein silver halide grains contained in the silver halide emulsion are chemically sensitized in the presence of a water-soluble sensitizing dye having a solubility in 20° C. water of 0.2 g/100 ml $H_2O$ or more, or said water-soluble sensitizing dye is added to the silver halide emulsion after chemical sensitization and before cooling to coagulate.

* * * * *